United States Patent [19]

Grams

[11] Patent Number: 4,567,727

[45] Date of Patent: Feb. 4, 1986

[54] PROPORTIONED HYDRAULIC SYSTEM

[75] Inventor: William H. Grams, Martins Creek, Pa.

[73] Assignee: Ingersoll-Rand Company, Woodcliff Lake, N.J.

[21] Appl. No.: 447,322

[22] Filed: Dec. 6, 1982

[51] Int. Cl.[4] ..... F15B 7/00; F15B 11/22

[52] U.S. Cl. ..... 60/546; 60/581; 60/579; 60/593; 91/520

[58] Field of Search ..... 60/579, 547.1, 546, 60/581, 591, 593; 91/520, 532

[56] References Cited

U.S. PATENT DOCUMENTS

| | | | |
|---|---|---|---|
| 3,069,124 | 12/1962 | Roberts | 60/591 |
| 3,485,046 | 12/1969 | Gebhardt | 60/593 |
| 3,609,974 | 10/1971 | Lado | 60/546 |
| 3,843,109 | 10/1974 | Bogosh | 60/547.1 |

FOREIGN PATENT DOCUMENTS

| | | | |
|---|---|---|---|
| 3047793 | 7/1982 | Fed. Rep. of Germany | 91/520 |

*Primary Examiner*—Edward K. Look
*Assistant Examiner*—H. Edward Li
*Attorney, Agent, or Firm*—R. J. Falkowski

[57] ABSTRACT

A hydraulic system is disclosed which provides automatic proportional actuation of pairs of hydraulic cylinders. The proportioning mechanism comprises one or more standard hydraulic cylinders.

2 Claims, 2 Drawing Figures

PROPORTIONED HYDRAULIC SYSTEM

BACKGROUND OF THE INVENTION

This invention relates to hydraulic systems for providing automatic proportioned actuation of pairs of hydraulic cylinders. Prior art devices generally use mechanical linkages for effecting proportional control. These mechanical linkages are often bulky and add considerable complexity to the system. Necessary clearances in the mating parts results in a substantial amount of play within the linkage system. This can be minimized by holding very close tolerances, however, this will greatly increase the cost of the mechanism.

Other prior art proportioning devices utilize all hydraulic components. Such devices use complex valving arrangements which are costly to manufacture and to maintain. These devices usually contain spool valves and restrictor valves containing delicate plungers, springs, accurately spaced ports and, in general, very closely fitting parts. This generally necessitates complex hydraulic interconnections.

What is needed is an automatic proportioned actuating hydraulic circuit composed exclusively of hydraulic components without the complex valving arrangement described above.

It is therefore an object of this invention to provide a proportioned hydraulic system of simple construction that is economical to manufacture.

It is another object of this invention to provide a proportioned hydraulic system utilizing all hydraulic components for effection proportioned control.

It is another object of this invention to provide a proportioned hydraulic system wherein proportioned control is effected by standard, commercially available hydraulic cylinders.

SUMMARY OF THE INVENTION

According to the present invention, there is provided a hydraulic system having a plurality of hydraulic cylinders, at least one of which is connected to a source of hydraulic pressure. A proportioning means is included, hydraulically interconnecting said plurality of cylinders for controlling the output of those cylinders, exclusive of and proportional to the output of, the hydraulic cylinder connected to the source of hydraulic pressure. The proportioning means consists of a plurality of hydraulic cylinders having their piston rods mechanically interconnected.

DESCRIPTION OF THE DRAWINGS

Other objects, features and advantages will become more apparent upon reading the following detailed description in conjunction with the accompanying drawings in which.

DESCRIPTION OF THE PREFERRED EMBODIMENT

Figure 1:
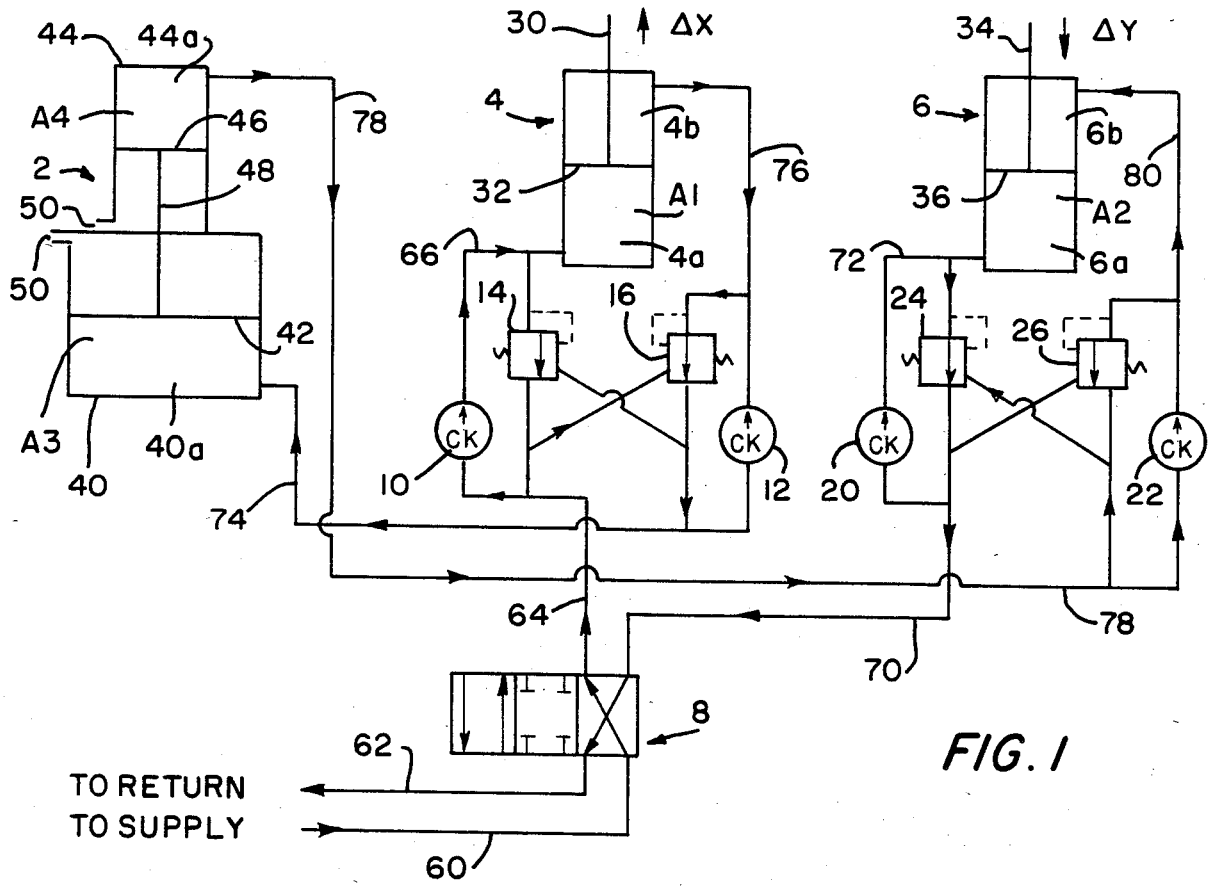
FIG. 1 is a schematic diagram of a hydraulic circuit showing a preferred embodiment of this invention.
Figure 2:
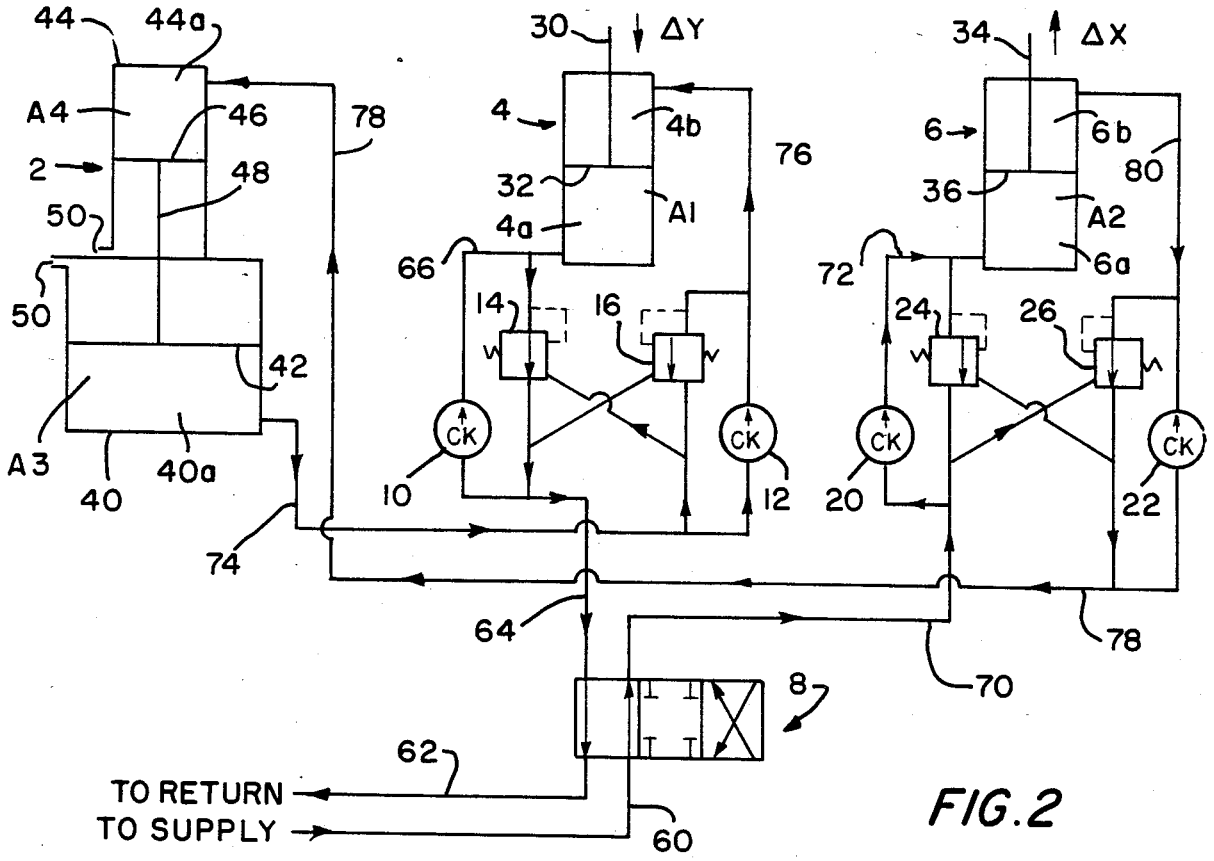
FIG. 2 is a schematic of a hydraulic circuit similar to that shown in FIG. 1, except that the directional valve is reversed.

Referring to FIGS. 1 and 2, there is shown a schematic of a hydraulic circuit having a remote master cylinder 2, a hydraulic cylinder 4 capable of operating in an X direction, and a hydraulic cylinder 6 capable of operating in another or Y direction. A directional valve

8 is arranged to direct hydraulic pressure from the supply to either the cylinder 4 or the cylinder 6. A pair of check valves 10 and 12, and a pair of sequence valves 14 and 16 are associated with the cylinder 4. Similarly, a pair of check valves 20 and 22, and a pair of sequence valves 24 and 26 are associated with the cylinder 6. The relationship of these valves to the hydraulic cylinders 4 and 6 will be described below.

The cylinder 4 includes a standard piston rod 30 and piston 32 having a surface area represented by the symbol Al. Similarly, the cylinder 6 includes a standard piston rod 34 and a piston 36 having a surface area represented by the symbol A2.

The remote master cylinder 2 is comprised of two cylinders of different diameters. The first cylinder 40 includes a piston 42 having a surface area indicated by the symbol A3. The second cylinder 44 has a piston 46 with a surface area indicated by the symbol A4. The two pistons 42 and 46 are interconnected by a common piston rod 48. The rod ends of the two cylinders 40 and 44 are vented to atmosphere at 50.

The directional valve 8 has two operating positions, a first operating position as shown in FIG. 1 and a second operating position as shown in FIG. 2. When the valve is in its center position, all hydraulic circuits are blocked resulting in no movement of the cylinders.

The hydraulic components are interconnected as follows. A conduit 60 connects the outside of the directional valve 8 to a source of hydraulic pressure, a conduit 62 connects the outside of the directional valve 8 to return, and a conduit 64 connects the inside of the directional valve 8 to the check valve 10, the sequence valve 14, and the control side of the sequence valve 16. A conduit 66 connects the other side of the check valve 10 and sequence valve 14 to the chamber **4*a* of the cylinder 4. A conduit 70 connects the inside of the directional valve 8 to the check valve 20, the sequence valve 24 and the control side of the sequence valve 26. A conduit 72 connects the other side of the check valve 20 and the sequence valve 24 to the chamber 6*a* of cylinder 6. A conduit 74 connects the chamber 40*a* of the cylinder 40 to the check valve 12 and the sequence valve 16. A conduit 76 connects chamber 4*b* of the cylinder 4 to the other side of the check valve 12 and the sequence valve 16. A conduit 78 connects the chamber 44*a* of the cylinder 44 to the check valve 22, the sequence valve 26 and the control side of the sequence valve 24. A conduit 80 connects the chamber 6*b* of the cylinder 6 to the other side of the check valve 22 and sequence valve 26**.

Each of the check valves 10, 12, 20 and 22 are arranged so that they permit flow in a direction toward the cylinders that they are associated with. On the other hand, each of the sequence valves 14, 16, 24 and 26 are arranged so that fluid flows through the valves in a direction away from the cylinders 4 and 6.

In operation, with the directional valve positioned as shown in FIG. 1, pressurized hydraulic fluid from the conduit 60 is communicated through the conduit 64, the check valve 10 and the control side of the sequence valve 16, thereby actuating that valve as shown. Hydraulic pressure is communicated through the conduit 66 and into the chamber **4*a* of the cylinder 4, thereby urging the piston 32 outwardly. This pressurizes or displaces the fluid in chamber 4*b* of the cylinder 4 which communicates with the conduit 76 leading to the check valve 12 and the sequence valve 16, which is open, thereby permitting the pressurized fluid to communicate with the conduit 74. Hydraulic pressure is thereby communicated to the chamber 40***a* of the cylinder 40, thereby urging the piston 42 upwardly as viewed in FIG. 1. Since the pistons 42 and 46 are connected by a common piston rod, the piston 46 also is urged upwardly displacing fluid in the chamber 44*a* of the cylinder 44. This pressurizes the conduit 78 which is in communication with the check valve 22 and the control side of the sequence valve 24, thereby opening that valve. The pressurized fluid in the conduit 78 then is in communication with the conduit 80 thereby pressurizing the chamber 6*b* of the cylinder 6.

The pressure in the chamber 6*b* urges the piston 36 downwardly as viewed in FIG. 1, thereby displacing fluid from the chamber 6*a* of the cylinder 6. This displaced fluid enters the conduit 72, flows through the sequence valve 24 that is now open, through the conduit 70, the directional valve 8, and into the return conduit 62.

For purposes of more clearly explaining the operation of the present invention, the directional valve 8 will be considered to be in the position shown in FIG. 1 for only a short period of time. After that time, the valve is moved to its center position where all conduits are blocked. While the valve is open, the piston 32 of the cylinder 34 is urged outwardly for an incremental distance $\Delta X$, as shown in FIG. 1. This causes a specific volume of fluid to be displaced from the chamber 4*b* and injected into the chamber 40*a* of the cylinder 40, causing the two pistons 42 and 46 to move upwardly a specific amount. This causes the displacement of a specific volume of fluid in the chamber 44*a* through the conduit 78, the check valve 22, the conduit 80 and into the chamber 6*b* of the cylinder 6. This causes the piston 36 to move downwardly, as viewed in FIG. 1, thereby moving the piston rod 34 an incremental distance $\Delta Y$.

The incremental distance $\Delta Y$ is proportional to the incremental distance $\Delta X$, the proportion being a function of the surface areas of the pistons 32, 36, 42, and 46. The specific relationship is that the incremental distance $\Delta X$ divided by the incremental distance $\Delta Y$ equals the surface area of the piston 36 times the surface area of the piston 42 divided by the surface area of the piston 32 times the surface area of the piston 46. That is to say:

$$\Delta X/\Delta Y=(A2A3)/(A1A4)$$

Similarly, with the directional valve 8 positioned as shown in FIG. 2, the pressurized fluid from the conduit 60 is communicated to the conduit 70, the control side of the sequence valve 26, through the check valve 20, the conduit 72 and into the chamber 6*a* of the cylinder 6. This urges the piston 36 and piston rod 34 upwardly an incremental amount $\Delta X$ as viewed in FIG. 2, displacing fluid from the chamber 6*b* which communicates through the conduit 80, the sequence valve 26 which is now open, through the conduit 78 and into the chamber 44*a* of the cylinder 44. This urges the pistons 46 and 42 downward as shown in FIG. 2, thereby displacing fluid from the chamber 40*a* of the cylinder 40, which communicates with the conduit 74, and through the check valve 12, conduit 76 and into the chamber 4*b* of the cylinder 4, thereby urging the piston 32 and piston rod 30 downwardly an incremental amount $\Delta Y$ as viewed in FIG. 2.

The amount of upward movement of the piston rod 34 is related to the downward movement of the piston rod 30 in exactly the same way as was described above with the directional valve positioned as shown in FIG. 1. This relationship is defined by the equation:

$$\Delta X/\Delta Y=(A2A3)/(A1A4)$$

Accordingly, there has been described a novel hydraulic system for providing automatic proportional actuation of pairs of hydraulic cylinders. It is understood that the above described embodiment is merely illustrative of the application of the principals of this invention. Upon reviewing the present disclosure, numerous other embodiments may be devised by those skilled in the art without departing from the spirit and scope of this invention as defined by the appended claims.

I claim:

1. A hydraulic system comprising:

a first double-acting hydraulic cylinder having a first chamber and a second chamber;

a second double-acting hydraulic cylinder having a first chamber and a second chamber;

a double-acting proportioning hydraulic cylinder having a first chamber with a selected pressure area and a second chamber with a pressure area selected to have a preselected different pressure area than the area of the first chamber;

a means for selectively connecting a hydraulic fluid source having a supply outlet and a return inlet to the hydraulic cylinders in a first connection mode and a second connection mode;

said first connection mode connecting the second chamber of the first cylinder to the supply outlet, connecting the second chamber of the second cylinder to the return inlet, connecting the first chamber of the first cylinder to the second chamber of the proportioning cylinder, and connecting the first chamber of the second cylinder to the first chamber of the proportioning cylinder; and said second connection mode connecting the second chamber of the second cylinder to the supply outlet, connecting the second chamber of the first cylinder to the return inlet, connecting the first chamber of the second cylinder to the first chamber of the proportioning cylinder, and connecting the first chamber of the first cylinder to the second chamber of the proportioning cylinder.

2. A system according to claim 1 wherein said means for selectively connecting comprises a valve movable to a first and second position to create the first connection mode and the second connection mode respectively.

* * * * *